US012433392B2

(12) United States Patent
Lu et al.

(10) Patent No.: US 12,433,392 B2
(45) Date of Patent: Oct. 7, 2025

(54) BRUSH FOR APPLYING A COSMETIC OR A CARE PRODUCT

(71) Applicant: APR Beauty Group, Inc., Toronto (CA)

(72) Inventors: Justin Lu, Ann Arbor, MI (US); Feng-Ying Fu, Markham (CA); Jun Shen, Lighthouse Point, FL (US)

(73) Assignee: APR Beauty Group Inc. (CA)

( * ) Notice: Subject to any disclaimer, the term of this patent is extended or adjusted under 35 U.S.C. 154(b) by 592 days.

(21) Appl. No.: 17/942,144

(22) Filed: Sep. 11, 2022

(65) Prior Publication Data

US 2024/0081519 A1 Mar. 14, 2024

(51) Int. Cl.

| | |
|---|---|
| ***A46B 1/00*** | (2006.01) |
| ***A45D 34/04*** | (2006.01) |
| ***A46B 9/02*** | (2006.01) |
| ***A46B 11/00*** | (2006.01) |

(52) U.S. Cl.

CPC ..... *A46B 9/021* (2013.01); *A45D 34/046* (2013.01); *A46B 1/00* (2013.01); *A46B 11/0086* (2013.01); *A46B 2200/1046* (2013.01)

(58) Field of Classification Search

CPC ..... A46B 9/021; A46B 1/00; A46B 11/0086; A46B 2200/1046; A46B 5/0008; A46B 9/023; A46B 2200/1013; A46B 2200/1033; A46B 2200/1053; A46B 2200/106; A46B 9/026; A46B 9/028; A45D 34/046; A45D 34/02; A45D 34/043; A45D 34/045; A45D 40/261; A45D 40/262; A45D 40/264; A45D 40/265; A45D 40/267; A45D 40/268; A45D 40/26; A45D 34/04; A45D 2029/002

See application file for complete search history.

(56) References Cited

U.S. PATENT DOCUMENTS

| | | | | |
|---|---|---|---|---|
| 11,758,997 | B1 * | 9/2023 | Zheng | A45D 34/046 401/129 |
| 2012/0009003 | A1 | 1/2012 | Gueret | |
| 2017/0265626 | A1 * | 9/2017 | Earl | A45D 40/04 |
| 2024/0023694 | A1 * | 1/2024 | Zheng | A45D 34/04 |

FOREIGN PATENT DOCUMENTS

| | | | | |
|---|---|---|---|---|
| DE | 202014003569 U1 * | 8/2014 | | A46B 3/005 |
| FR | 3111774 A1 * | 12/2021 | | A46B 9/026 |

OTHER PUBLICATIONS

Geka Translation (Year: 2014).*
La Montagna (Year: 2021).*

* cited by examiner

*Primary Examiner* — Eric J Rosen
*Assistant Examiner* — Luis Ruiz Martin
(74) *Attorney, Agent, or Firm* — Jason L DeFrancesco

(57) ABSTRACT

A brush for applying a product including a cosmetic, care, or pharmaceutical product onto the keratinous surface of a user. The applying member includes a support head and a plurality of bristles extends from a distal end face of the support head along a longitudinal axis of the support head. The distal end face of the support head comprises a first distal end face and a second distal end face. The first distal end face and the second distal end face are substantially flat surfaces that intersect each other to form a ridge on the distal end face. The ridge on the distal end face extends along an axis perpendicular to a longitudinal axis of the support head.

18 Claims, 7 Drawing Sheets

BRUSH FOR APPLYING A COSMETIC OR A CARE PRODUCT

BACKGROUND

Field of the Invention

The present disclosure generally relates to a brush and preferably a brush for applying a cosmetic or a care product on a keratinous surface of a user. The cosmetic or care product is a liquid or a semi-liquid product.

Description of the Related Art

Eye care and beauty care have become a very essential part of modern-day routine beauty care. Particularly, people are using cosmetic care products such as serums on eyelashes for the growth of the eyelashes. The serum is also known to help repair and restore lashes and brows. The type of eyelash brush used for applying serums is incredibly important for the success of the treatment.

The sizes of brushes that are usually employed for applying mascara do not effectively apply serum to the lash roots as they are very big. It is difficult to reach small lashes at the bottom lash line using a big brush. Further, these kinds of brushes take an excessive amount of content from the container, and as a result, the excess content is prone to fall into the eye.

US20120009003 discloses an applicator with a comb for applying a substance to eyelashes and/or eyebrows comprising a support and teeth extending substantially transversely relative to a longitudinal axis of the support.

There is still a need for a brush that is small in size and can effectively apply a cosmetic care product such as a serum to the eyelashes or eyebrows of a user.

SUMMARY

It is an object of the present disclosure to provide a cosmetic package containing a cosmetic or a care product and a brush.

It is another object of the present disclosure to provide a brush that can apply a cosmetic product, a care product, a pharmaceutical product, or like products onto a keratinous surface such as an eyelash, eyebrow, lips, skin, or under-eye. Further, the product can be a liquid or semi-solid product. The liquid product may include a low or a high viscosity product.

It is a further object to provide a brush that can apply an optimum amount of serum or a liquid without the need of re-dipping the brush into the product. The brush may include faces that are suitable for applying and distributing a cosmetic product on a keratinous surface.

It is yet another object of the present disclosure to provide a brush that is small in size and can provide a precise application of product to eyelashes or eyebrows. The brush is very simple to use, economical to manufacture, and ergonomically pleasing.

Accordingly, there is provided a brush according to a preferred embodiment of the present disclosure. The brush comprises a support head elongated along a central longitudinal axis of applying member and a plurality of bristles extending from the distal end face of the support head to a distal end of the brush. Thus, the distal end face forms a support surface for the bristles. The rest of the faces of the support head is free from the bristles or are bristle-free.

According to an aspect of the present disclosure, there is provided a cosmetic package comprising a receptacle for holding a cosmetic product and a cosmetic applicator. The cosmetic applicator comprises the brush, a stem, and a cap. The cap of the cosmetic applicator has internal threads that can be screwed onto outer threads, formed on a neck of the receptacle. The brush is retained at a distal end of the stem for applying the product; and the cap at a proximal end of the stem.

In general, the use of the terms "distal" and "proximal" herein is supposed to mean that the distal is the end facing towards the inside of the storage receptacle, whereas the proximal is the end facing towards a removal opening on the neck of the receptacle.

According to an aspect of the present disclosure, the distal end of the stem includes an interior longitudinal cavity for receiving and retaining the brush. Further, there is provided in the neck of the receptacle a wiper for wiping off excess product from the cosmetic applicator.

Further, the brush of a cosmetic applicator may be used to apply the product including a cosmetic or skincare product. The cosmetic or skincare product includes eyelash serum, viscous cosmetics, eye cosmetics or eye care products, pharmaceutical, and like products.

The brush has an applying member defined by a distal portion thereof and a shank member defined by a proximal portion thereof. The shank member is configured to be received and retained within the cavity of the stem.

In the present embodiment, the shank member and the applying member are integral, however in alternate embodiments that may be two separate parts. The applying member is designed to apply the product to a target surface. Further, the shank member of the support head may be secured to the stem, for example, a press-fit, snap-fit, adhesive, and/or engagement by one or more engagement features.

According to an embodiment, the shank member is designed as a conical structure, wherein the top width of the shank member is about 1.5 mm and the base width of the shank member is about 2.5 mm respectively. In alternate embodiments, however, the shank member may have any other suitable shape such as cylindrical, rectangular, hexagonal, or the like.

The brush is elongated along a central longitudinal axis of the cosmetic applicator. The applying member has a distal end and a proximal end that are opposite relative to the central longitudinal axis and are separated, along said central longitudinal axis, by a distance in a range of about 9 mm to 12 mm. Said distance also defines the length of the applying member.

According to an aspect of the present embodiment, a proximal portion of the applying member includes a support head and a distal portion of the applying member has a plurality of bristles. The plurality of bristles extends from a distal end face of the support head along the central longitudinal axis of the support head.

According to another aspect of the present embodiment, the support head and the applying member have a longitudinal axis, which regularly coincides with the longitudinal axis of the cosmetic applicator.

According to an aspect of the present embodiment, the support head is elongated along the central longitudinal axis of the applying member. A proximal portion of the support head has a constant transverse cross-section that is constant in shape and area. In the preferred embodiment, from a proximal end of the support head up to ⅔ of the length of the support head, the support head has a constant transverse cross-section. A distal portion of the support head has varying transverse cross-sections along the central longitudinal axis of the support head. More particularly, the area of the transverse cross-sections of the distal portion of the support head decreases towards the distal end of the support head.

According to yet another aspect of the present disclosure, the shape of the constant transverse cross-section of the support head is substantially a square with two curved sides and four rounded corners. The cross-sectional area has a height-to-width ratio of 1:1. In other embodiments, the transverse cross-section of a major portion of the support head may be rectangular, oval, or circular.

According to yet another aspect of the present disclosure, the support head further includes a front face, a back face, a right face, a left face, and the distal end face. The front face is opposing the back face, and the left face is opposing the right face.

According to yet another aspect of the present disclosure, the front face of the support head has a smaller surface area than a surface area of the back face. In a preferred embodiment, the surface area of the front face of the support head is at least 30% lesser than the surface area of the back face of the support head.

According to yet another aspect of the present disclosure, the front face has a length less than a length of the back face. Preferably, the length of the front face is at least one-third of the length of the back face of the support head and at most three-fourths the length of the back face of the support head.

According to yet another aspect of the present disclosure, the support head of the brush has a plurality of longitudinal grooves oriented longitudinally and which are non-uniformly distributed around the central longitudinal axis of the support head. More particularly, each of the front face and back face of the support head is provided with multiple longitudinal grooves, and each of the left face and the right face of the support head is devoid of any longitudinal grooves. The longitudinal grooves extend over the majority of a longitudinal length of each of the front face and the back face. In a preferred embodiment, the longitudinal grooves extend on the complete length of the respective front and the back face. In a preferred embodiment, each of the front face and the back face of the support head is provided with four longitudinal grooves. Further, there is provided a longitudinal spacing region between two adjacent longitudinal grooves.

According to a preferred embodiment, at least one longitudinal groove has a predefined constant width along its entire length. Preferably, each of the longitudinal grooves has a predefined constant width along an entire length of the longitudinal groove. In alternate embodiments, however, at least one longitudinal groove of the longitudinal grooves may have a width that varies along the length of the at least one longitudinal groove.

In a preferred embodiment, the longitudinal grooves have the same widths. In an alternate embodiment, at least one of the longitudinal grooves on the support head may have a width different from the widths of the rest of the longitudinal grooves.

According to yet another aspect of the present disclosure, the longitudinal grooves facilitate the flow of the cosmetic product axially along the outer surface of the support head. These longitudinal grooves considerably accelerate the flow of the extra cosmetic product towards the distal end face of the support head so that a suitable amount of the cosmetic product can flow to the bristles.

Furthermore, the longitudinal grooves of the support head can have any shapes or profiles. For example, longitudinal grooves may be c-shaped, v-shaped, or any other shape cross-sections known in the art.

According to an aspect of a preferred embodiment, the distal end face of the support head is not a planar. The distal end face of the support head comprises a first distal end face and a second distal end face. The first distal end face and the second distal end face are substantially flat surfaces and are disposed in different planes from one another. The first distal end face and the second distal end face intersect each other to form a ridge at their intersection. The ridge extends along an axis perpendicular to the central longitudinal axis of the support head. The distal end face includes two intersecting planes namely a first plane and a second plane. The first distal end face lies on the first plane and the second distal end face lies on the second plane. The first plane and the second plane intersect at an angle of between 100 to 150 degrees. In a preferred embodiment, the first plane and the second plane intersect one another at an angle of between 100 degrees to 120 degrees. In other words, the first distal end face and the second distal end face intersect one another at an angle of between 100 to 120 degrees.

According to yet another aspect of the present disclosure, the first distal end face and the second distal end face are both inclined surfaces that intersect with each other at an angle. The first distal end face inclines toward one side of the support head, and the second distal end face inclines in the opposite direction. In a preferred embodiment, the first distal end face inclines towards the back face of the support head and the second distal end face inclines to the front face opposite the back face of the support head. The first distal end face forms an inclination angle relative to a longitudinal axis of the support head. The longitudinal axis of the support head is an axis that passes through the ridge and is parallel to the longitudinal central axis of the support head. The second distal end face forms an inclination angle $\beta$ relative to the longitudinal axis of the support head. The inclination angles of the first distal end face and the second distal end face are unequal. In other words, the first distal end face and the second distal end face are inclined relative to the longitudinal axis of the support head at different inclination angles. The inclination angle of the first distal end face with respect to the longitudinal axis of the support head is in a range between 90 to 140 degrees, preferably, between 100 to 110 degrees. The inclination angle of the second distal end face with respect to the longitudinal axis of the support head is in a range from 125 to 170 degrees, preferably between 130-150 degrees.

According to yet another aspect of the present disclosure, the first distal end face has a smaller surface area than a surface area of the second distal end face. The surface area of the first distal end face is at least 10% and at most 40% of the total surface area of the distal end face and the second distal end face is at least 60% and at most 90% of the total surface area of the distal end face. Preferably, the surface area of the first distal end face is at least 20% of the total surface area of the distal end face, and the second distal end face is at most 80% of the total surface area of the distal end face.

According to yet another aspect of the present disclosure, the ridge is formed at a plane of intersection between the first distal end face and the second distal end face. The ridge is spaced from the central longitudinal axis of the support head and is located on the distal end face closer to the back face of the support head. The ridge between the first distal end face and the second distal end face extends across the distal end face from an outer edge portion of the distal end face adjoining the left face of the support head to another outer edge portion of the distal end face adjoining the right face of the support head.

According to yet another aspect of the present disclosure, the second distal end face extends along at least 20% of the length of the support head, preferably, at least 30% of the length of the support head and at most 50% of the length of the support head. The first distal end face extends along at most 10% of the length of the support head, preferably at most 5% of the length of the support head. The second distal end face is inclined which increases the surface area of the second distal end face and also helps in retaining the cosmetic product between the bases of bristles on the second distal end face.

According to yet another aspect of the present disclosure, the left face and right face of the support head are symmetrical relative to a plane of symmetry comprising the central longitudinal axis of the brush. The right face and the left face are substantially planar surfaces.

According to yet another aspect of the present disclosure, the plurality of bristles extends from the distal end face along the central longitudinal axis of the applying member towards a distal end of the applying member. The bristles are arranged essentially parallel to each other, and the longitudinal axes of the bristles run essentially parallel to the central longitudinal axis of the brush. The distal end face forms a support surface for the plurality of bristles, and the rest of the faces of the support head are bristle-free.

According to yet another aspect of the present disclosure, the plurality of bristles are integrally molded or injection molded with the support head. The arrangement of bristles on the distal end face may be a circular array or a rectangular array or any other either regular or irregular form.

According to yet another aspect of the present disclosure, the distal end face of the support head supports a plurality of bristles of different lengths. Particularly, the first distal end face supports bristles of short length, and the second distal end face supports bristles of long length. The bristles of the longest length are located on the second distal end face close to a portion of the outer edge adjoining the right face of the support head. The length of the bristles on the second distal end face decreases gradually towards the ridge and increases on moving away from the ridge.

According to yet another aspect of the present disclosure, a row of bristles is located on the ridge. The row of bristles located on the ridge is shorter in length than the bristles of the second distal end face but longer in length than the bristles of the first distal end face. The length of bristles may range between 3-8 mm. Further, free distal ends of the plurality of bristles form a wavy plane. In alternate embodiments, however, the free distal ends of the plurality of bristles may not form a wavy plane.

According to yet another aspect of the present disclosure, the brush includes a mix of soft and hard bristles. The soft bristles are the bristles that are longer in length and are located near the outer edge of the distal end face on the first distal end face. The hard bristles are bristles that are short in length and are located near a portion of the outer edge of the distal end face on the first distal end face. The intermediate bristles are of medium hardness.

In a preferred embodiment, the number of bristles on the distal end face is greater than 15 and less than 20. In alternate embodiments, the number of bristles may be more than 20.

In a preferred embodiment, each bristle has a conical shape, with a free top end diameter of the bristle being about 0.14 mm and a base diameter of the bristle being about 0.3 mm. Further, the top end of each of the bristles is rounded for providing smoothness. In alternate embodiments, not shown, the bristles can be of any other shape known in the art.

It is also worth noting that the bristles all maintain a defined spacing from each other, i.e., the individual bristles do not come in contact with neighboring bristles when there is no application force.

Further, a ratio of the length of the support head and the length of the bristles range from about 2:3 to 3:2. The ratio of each of the bristles and the length of the support head lies in the range of about 2:3 to 3:2.

The front face of the support head has a height less than the height of the back face of the support head. The height of the front face is at least one-third of the height of the back face of the support head. Further, the support head of the cosmetic applicator may be used to apply the product including a cosmetic or care product. The cosmetic or care product includes viscous cosmetics, mascara, eyebrow powder, lip gloss, hair color, skincare, under-eye cosmetics, pharmaceutical, and like products.

According to an aspect of the present disclosure, the shank member of the support head may be secured to the stem, for example, a press-fit, snap-fit, adhesive, and/or engagement by one or more engagement features.

According to an embodiment of the present disclosure, at least a part of the support head can be made by molding, e.g. by injection-molding, e.g. in a material selected from the following list: thermoplastic materials; elastomers; thermoplastic elastomers; thermoplastic elastomer polyester such as low-density polyethylene(LDPE); HYTREL®; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

In the first embodiment, the wiper serves to wipe off not only the excess cosmetic product attached to the applying member but also the cosmetic product attached to the stem. According to a preferred embodiment, the receptacle and the cap may be made of a rigid material like glass, metal, hard plastic, or any other material known in the art. However, in alternate embodiments, the receptacle and the cap may be made of a flexible material like flexible polymeric material or any other material known in the art.

According to an aspect of the present disclosure, the stem presents a circular cross-section, but it is not beyond the ambit of the present disclosure for this to be otherwise, in particular when the cross-section of the stem is oval, elliptical, or polygonal, e.g. square, triangular or rectangular. The stem can be solid as shown, or, in a variant, it could be hollow.

When the stem is not of circular cross-section, the cap can be fastened on the receptacle by snap-fastening or by some other means, without turning relative to said receptacle. The wiper can thus present a non-circular wiper orifice of the section that is complementary to the section of the stem.

According to an embodiment of the present disclosure, the support head can be made, at least in part, from a material that is more flexible than the material from which the stem is made.

According to the present disclosure, the stem can have a longitudinal axis that is rectilinear as shown. However, in alternate embodiments, it could be curved.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the disclosure. In addition, those skilled in the art may readily change or modify to the disclosed embodiments, based on the present specification, such changes or modifications also belong to the scope of the present disclosure will be apparent.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
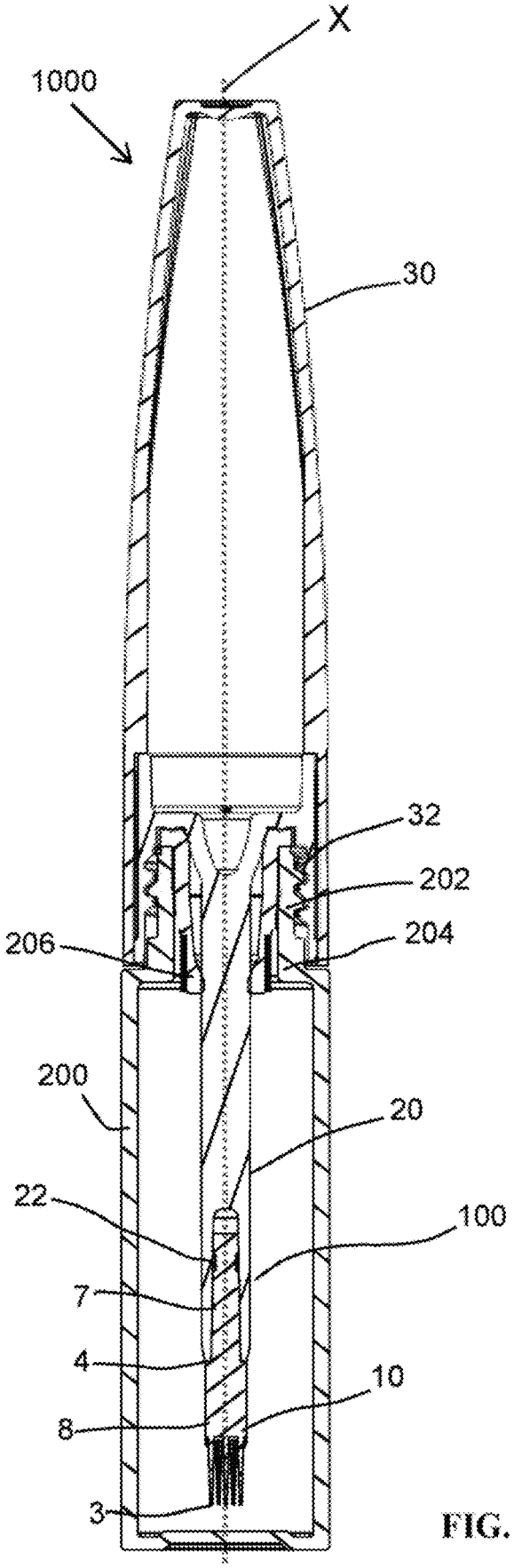
FIG. 1 illustrates a longitudinal cross-sectional view of a cosmetic package equipped with a cosmetic applicator according to a first embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered limited by the foregoing description.

Throughout this specification, the terms "comprise," "comprises," "comprising" and the like, shall consistently mean that a collection of objects is not limited to those objects specifically recited.

Figure 2:
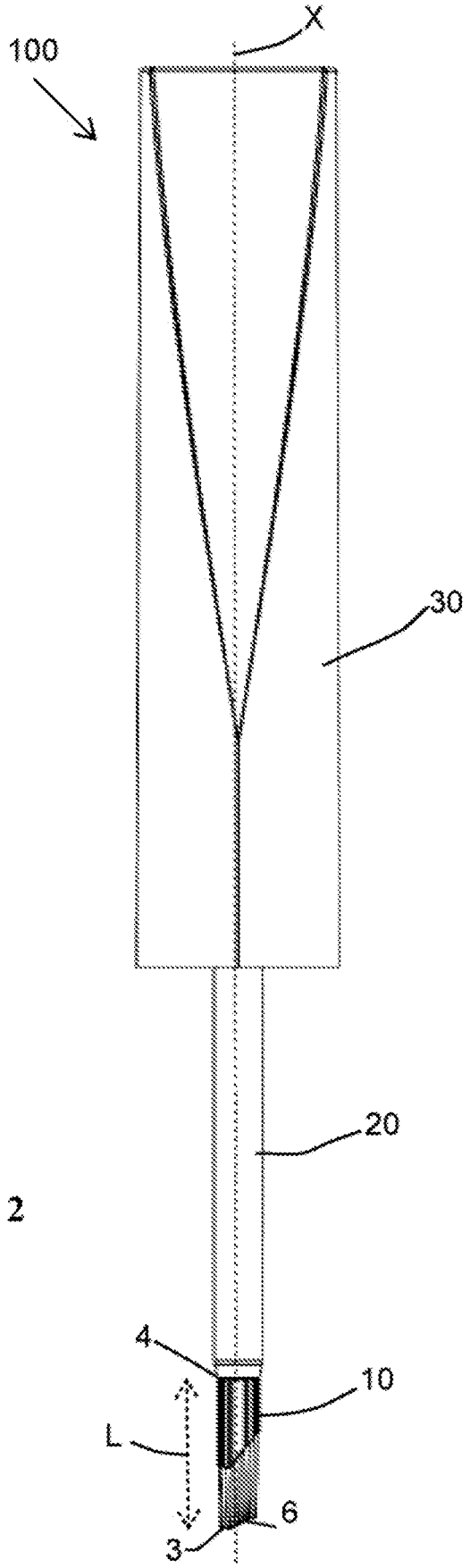
FIG. 2 illustrates a side view of the cosmetic applicator of the cosmetic package of FIG. 1.

FIG. 1 illustrates a longitudinal cross-sectional view of a cosmetic package 1000. The cosmetic package 1000 comprises a receptacle 200 for holding a product (not shown) and a cosmetic applicator 100. The cosmetic applicator 100 comprises a brush 10, a stem 20, and a cap 30, see FIGS. 1 & 2. The cap 30 of the cosmetic applicator 100 has internal threads 32 that can be screwed onto outer threads 202, formed on a neck 204 of the receptacle 200. The brush 10 is retained at a distal end of the stem 20 for applying the product; and the cap 30 at a proximal end of the stem 20.

In general, the use of the terms "distal" and "proximal" herein is supposed to mean that the distal is the end facing towards the inside of the storage receptacle 200, whereas the proximal is the end facing towards a removal opening on the neck of the receptacle 200.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As seen in FIG. 1, the distal end of the stem 20 includes an interior longitudinal cavity 22 for receiving and retaining the brush 10. Further, there is provided in the neck 204 of the receptacle 200 a wiper 206 for wiping off excess product from the cosmetic applicator 100.

Further, the brush 10 of cosmetic applicator 100 may be used to apply the product including a cosmetic or skin care product. The cosmetic or skincare product includes eyelash serum, viscous cosmetics, eye cosmetics or eye care products, pharmaceutical, and like products.

As shown in FIGS. 3-8, the brush 10 has an applying member 8 defined by a distal portion thereof and a shank member 7 defined by a proximal portion thereof. The shank member 7 is configured to be received and retained within the cavity 22 of the stem 20, see FIG. 1.

In the present embodiment, the shank member 7 and the applying member 8 are integral, however in alternate embodiments that may be two separate parts. The applying member 8 is designed to apply the product to a target surface. Further, the shank member 7 of the support head 5 may be secured to the stem 20, for example, a press-fit, snap-fit, adhesive, and/or engagement by one or more engagement features. Moreover, the shank member 7 is designed as a conical structure, wherein the top width of the shank member 7 is about 1.5 mm and the base width of the shank member 7 is about 2.5 mm respectively.

The brush cis elongated along a central longitudinal axis X of the cosmetic applicator 100 (refer to FIG. 1). The applying member 8 has a distal end 3 and a proximal end 4 that are opposite relative to the axis X and are separated, along said axis X, by a distance marked L in FIG. 2. Wherein, said distance L is between 9 mm to 12 mm. The distance L is the length of the applying member 8.

Figure 3:
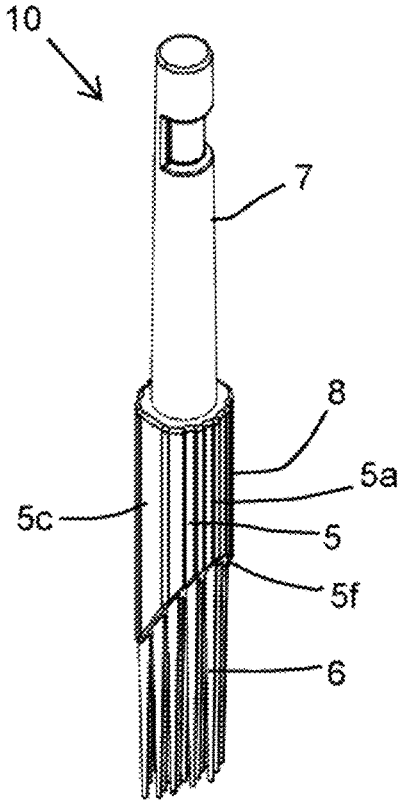
FIG. 3 illustrates a perspective view of a brush of the cosmetic applicator of FIG. 2.

As illustrated in FIG. 3, a proximal portion of the applying member 8 includes a support head 5 and a distal portion of the applying member 8 has a plurality of bristles 6 extending from a distal end face **5*f* of the support head 5**.

The support head 5 and the applying member 8 have a longitudinal axis, which regularly coincides with the longitudinal axis X of the cosmetic applicator 100.

Figure 4:
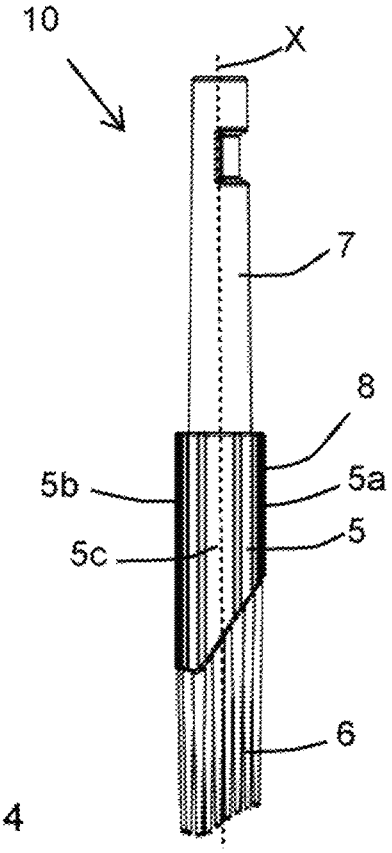
FIG. 4 illustrates a left side view of the brush of FIG. 3.
Figure 11:
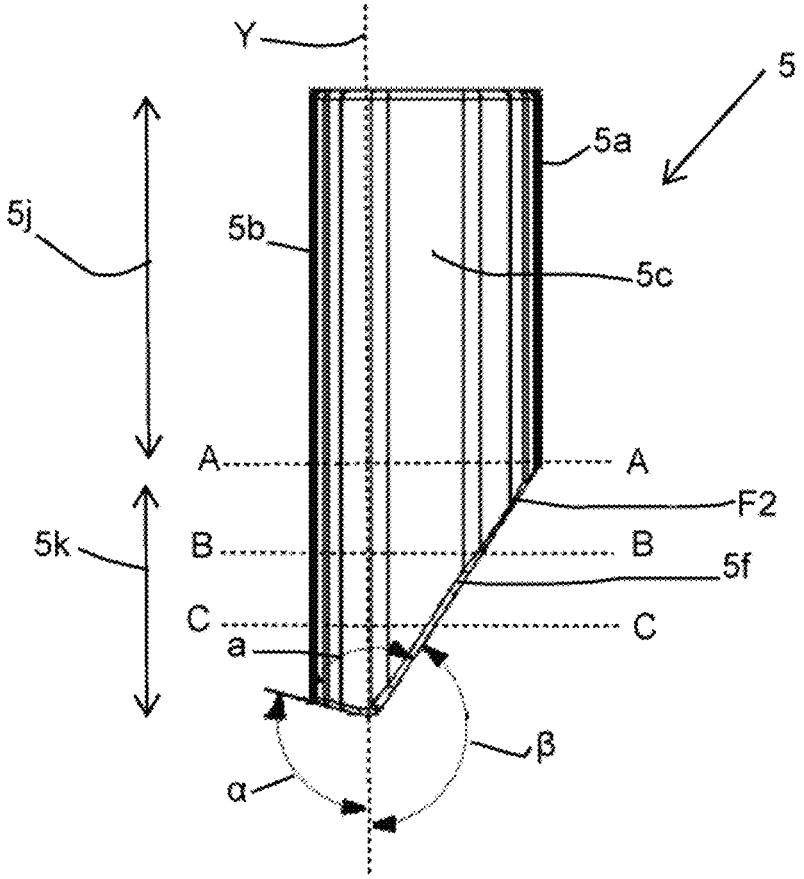
FIG. 11 illustrates an enlarged left side view of a support head of the brush of FIG. 4, the support head is shown in isolation for showing the details thereof, and with bristles thereon removed for clarity.
Figure 12:
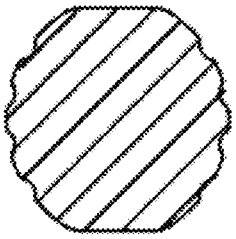
FIG. 12 illustrates schematically a transverse cross-section along plane A-A through the support head of FIG. 11.

Further as seen in FIG. 4, the support head 5 is elongated along the central longitudinal axis X of the applying member 8. As seen in FIGS. 11 and 12, a proximal portion **5*j* of the support head 5 has a constant transverse cross-section that is constant in shape and area. In the preferred embodiment, from a proximal end of the support head 5 up to ⅔ of the length of the support head 5, the support head 5 has a constant transverse cross-section. A distal portion 5*k* of the support head 5 has varying transverse cross-sections along the central longitudinal axis X. More particularly, the area of the transverse cross-sections of the distal portion 5***b* of the support head 5 decreases towards the distal end of the support head 5, see FIGS. 13 and 14.

Figure 13:
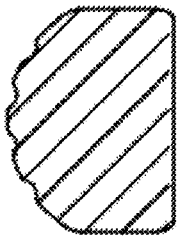
FIG. 13 illustrates schematically a transverse cross-section along plane B-B through the support head of FIG. 11.
Figure 14:
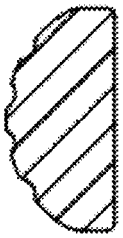
FIG. 14 illustrates schematically a transverse cross-section along plane C-C through the support head of FIG. 11.
Figure 15:
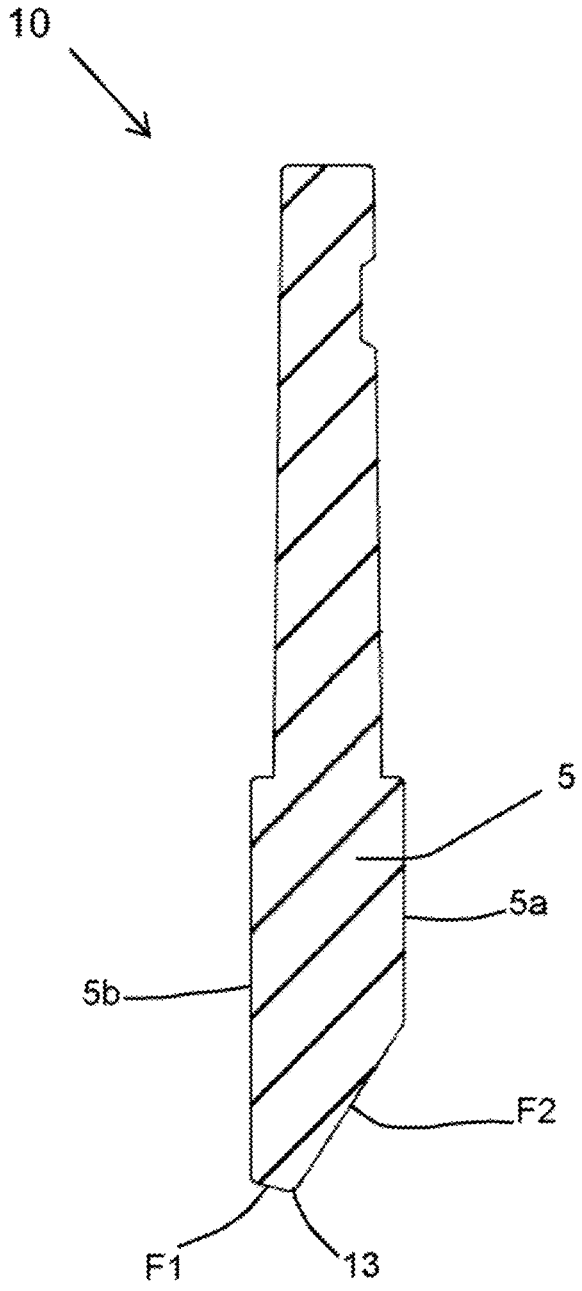
FIG. 15 illustrates a longitudinal cross-sectional view of the brush of FIG. 4, with bristles thereon removed for clarity.

Further, FIG. 12 illustrates schematically the constant transverse cross-section along plane A-A through the support head 5 of FIG. 11. Further, the shape of the constant transverse cross-section of the support head 5 is substantially a square with two curved sides and four rounded corners referring to FIGS. 11 and 12. The cross-sectional area has a height-to-width ratio of 1. FIG. 13 illustrates schematically the transverse cross-section along plane B-B through the support head 5 of FIG. 11, and FIG. 14 illustrates schematically the transverse cross-section along plane C-C through the support head 5 of FIG. 11. The transverse cross-sections in FIGS. 13 and 14 are substantially D-shaped.

In other alternate embodiments, not shown, the transverse cross-section of the support head may be rectangular, oval, or circular. Referring to FIGS. 3-6, the support head 5 further includes a front face 5*a*, a back face 5*b*, a right face 5*d*, a left face 5*c*, and the distal end face 5*f*. The front face 5*a* is opposing the back face 5*b*, and the left face 5*c* is opposing the right face 5*d*.

Figure 5:
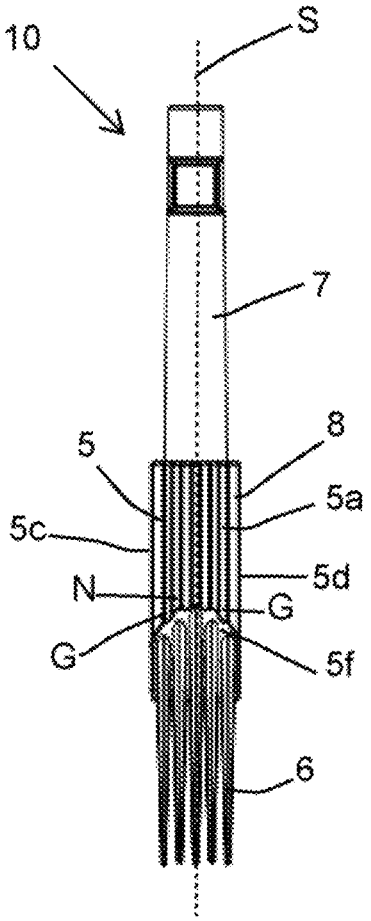
FIG. 5 illustrates a front view of the brush of FIG. 3.
Figure 6:
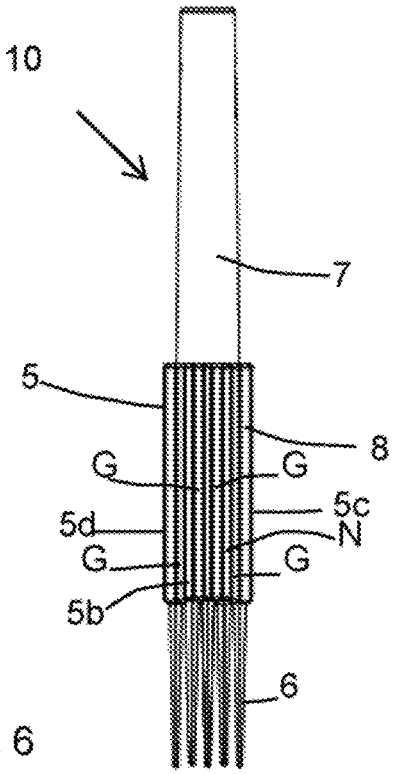
FIG. 6 illustrates a back view of the brush of FIG. 3.

Preferably, the front face 5*a* of the support head 5 has a smaller surface area than the surface area of the back face 5*b*, refer to FIGS. 4-6. In the illustrated embodiment, the surface area of the front face 5*a* is at least 30% lesser than the surface area of the back face 5*b*. Furthermore, the front face 5*a* has a length L1 less than a length L2 of the back face 5*b* see FIG. 7. Preferably, the length L1 of the front face 5*a* is at least one-third of the length L2 of the back face 5*b* of the support head 5 and at most three-fourths the length of the back face 5*b* of the support head 5.

Figure 10:
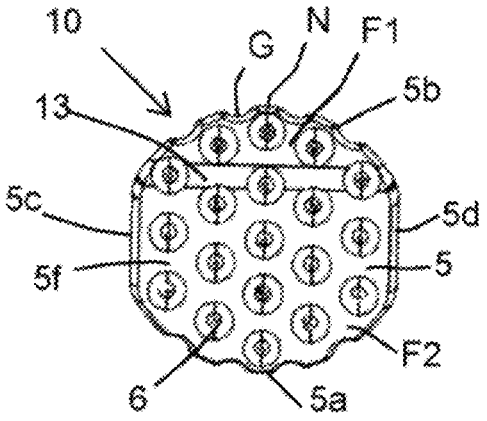
FIG. 10 illustrates a bottom view of the brush of FIG. 3.

Referring to FIGS. 5, 6, and 10, the support head 5 has multiple longitudinal grooves G oriented longitudinally and which are non-uniformly distributed around the central longitudinal axis X. More particularly, each of the front face 5*a* and the back face 5*b* of the support head 5 is provided with multiple longitudinal grooves G and each of the left face 5*c* and the right face 5*d* is devoid of the longitudinal grooves. The longitudinal grooves G extend over the majority of a longitudinal length of each of the front face 5*a* and the back face 5*b*. As illustrated, the longitudinal grooves G extend on the complete length of the respective front and the back faces 5*a*, 5*b*. In the exemplary embodiment, each of the front face 5*a* and back face 5*b* of the support head 5 is provided with four longitudinal grooves G. Further, there is provided a longitudinal spacing region N between two adjacent longitudinal grooves G.

In the exemplary embodiment, at least one of the longitudinal grooves G has a predefined constant width along an entire length of the longitudinal groove G. Preferably, each of the longitudinal grooves G has a predefined constant width along an entire length of the longitudinal groove G. In alternate embodiments, however, at least one of the longitudinal grooves G may have a width that varies along the length of the longitudinal groove.

The longitudinal grooves G facilitate the flow of the cosmetic product axially along the outer surface of the support head 5. These grooves considerably accelerate the flow of extra cosmetic product towards the distal end face 5*f* of the support head 5 so that the suitable amount of the cosmetic product can flow to the plurality of bristles 6.

In the exemplary embodiment, the longitudinal grooves G have the same widths, see FIGS. 5, 6, and 10. In an alternate embodiment, at least one of the longitudinal grooves G on the support head 5 may have a width different from the widths of the rest of the longitudinal grooves G.

Furthermore, the longitudinal grooves G of the support head 5 can have any shapes or profiles. For example, longitudinal grooves G may be c-shaped, v-shaped, or any other shape known in the art.

According to an aspect of the present embodiment, referring to FIGS. 3, 5, 7, 10, 11, and 15, the distal end face 5*f* of the support head 5 is not a planar face. With reference to FIG. 11, in a preferred embodiment, the distal end face 5*f* of the support head 5 comprises a first distal end face F1 and a second distal end face F2. The first distal end face F1 and the second distal end face F2 are substantially flat surfaces and are disposed in different planes from one another. The first distal end face F1 and the second distal end face F2 intersect each other to form a ridge 13 at their intersection. The ridge 13 extends along an axis perpendicular to the central longitudinal axis X of the support head 5. The distal end face 5*f* includes two intersecting planes namely a first plane and a second plane. The first distal end face F1 lies on the first plane and the second distal end face F2 lies on the second plane. The first plane and the second plane intersect one another at an angle a of between 90 to 150 degrees. In a preferred embodiment, the first plane and the second plane intersect one another at an angle a of between 100 to 120 degrees. In other words, the first distal end face F1 and the second distal end face F2 intersect one another at an angle a of between 100 to 120 degrees.

The first distal end face F1 and the second distal end face F2 are both inclined surfaces that intersect with each other at the angle a. The first distal end face F1 inclines toward one side of the support head 5 and the second distal end face F2 inclines in the opposite direction to the first distal end face F1. In the exemplary embodiment, the first distal end face F1 inclines towards the back face 5*b* of the support head 5, and the second distal end face F2 inclines to the front face 5*a* opposite the back face 5*b* of the support head 5. The first distal end face F1 forms an inclination angle $\alpha$ relative to a longitudinal axis Y. The longitudinal axis Y is an axis that passes through the ridge 13 and is parallel to the longitudinal central axis X of the support head 5. The second distal end face F2 forms an inclination angle $\beta$ relative to the longitudinal axis Y. The inclination angles $\alpha$ and $\beta$ of respective the first distal end face F1 and the second distal end face F2 are unequal. In other words, the first distal end face F1 and the second distal end face F2 are inclined relative to the longitudinal axis Y at different inclination angles. The inclination angle $\alpha$ of the first distal end face F1 with respect to the longitudinal axis Y of the support head 5 is in a range between 90 to 140 degrees, preferably, between 100 to 110 degrees. The inclination angle $\beta$ of the second distal end face F2 with respect to the longitudinal axis Y of the support head 5 in a range from 125 to 170 degrees, preferably between 130 to 150 degrees.

As seen in FIG. 10, the first distal end face F1 has a smaller surface area than the surface area of the second distal end face F2. The surface area of the first distal end face F1 is at least 10% of the total surface area of the distal end face 5*f* and the second distal end face F1 is at most 90% of the total surface area of the distal end face 5*f*. Preferably, the surface area of the first distal end face F1 is at least 20% of the total surface area of the distal end face 5*f* and the second distal end face F1 is at most 80% of the total surface area of the distal end face 5*f*.

The ridge 13 or a plane of intersection between the first distal end face F1 and the second distal end face F2 is spaced from the central longitudinal axis X of the support head 5 and is located closer to the back face 5*b* on the distal end face 5*f* of the support head 5 than to the front face 5*a* of the support head 5. The ridge 13 between the first distal end face F1 and the second distal end face F2 extends across the distal end face 5*f* from an outer edge portion of the distal end face 5*f* adjoining the left face 5*c* to another outer edge portion of the distal end face 5*f* adjoining the right face 5*d* of the support head 5.

The second distal end face F2 extends along at least 20% of the length of the support head 5, preferably, at least 30% of the length of the support head 5 and at most 50% of the length of the support head 5. The first distal end face F1 extends along at most 10% of the length of the support head 5, preferably at most 5% of the length of the support head 5.

In the exemplary embodiment, as illustrated by FIGS. 4, 5, and 6, the left face 5*c* and right face 5*d* are symmetrical relative to a plane of symmetry S comprising the longitudinal axis X. The right face 5*d* and the left face 5*c* are substantially planar surfaces.

Further, as seen in FIG. 3 to FIG. 8, the plurality of bristles 6 extends from the distal end face 5*f* along a longitudinal axis X of the applying member 8 towards a distal end 3 of the applying member 8. The bristles 6 are arranged essentially parallel to each other and the longitudinal axes of the bristles 6 run essentially parallel to the longitudinal axis X of the support head 5 or the brush 10. The distal end face 5*f* forms a support surface for the plurality of bristles 6, and the rest of the faces 5*a*, 5*b*, 5*c*, and 5*d* of the support head 5 are bristle-free.

According to an aspect of the present disclosure, the plurality of bristles 6 are integrally molded or injection molded with the support head 5. Further, the arrangement of bristles 6 on the distal end face 5*f* may be a circular array or a rectangular array or any other either regular or irregular form.

Figure 7:
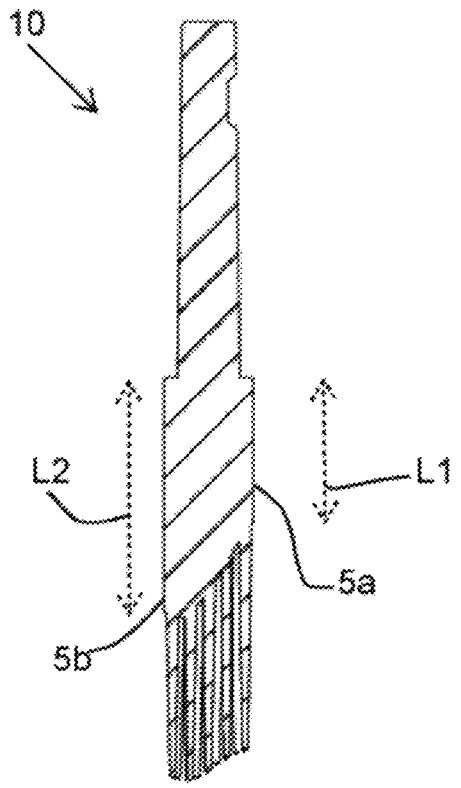
FIG. 7 illustrates a longitudinal cross-sectional view of the brush of FIG. 3.
Figure 8:
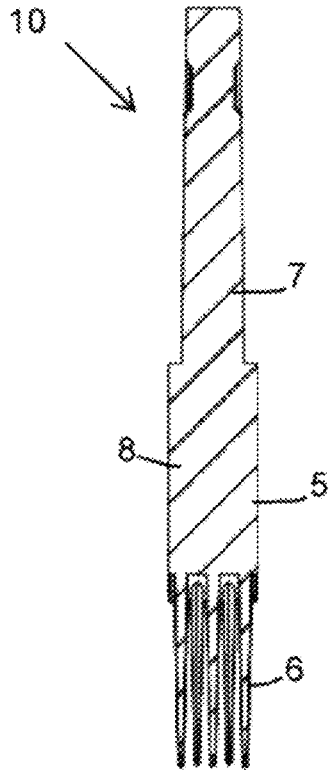
FIG. 8 illustrates another longitudinal cross-sectional view of the brush of FIG. 3.
Figure 9:
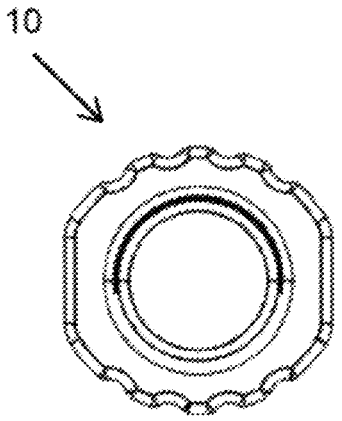
FIG. 9 illustrates a top view of the brush of FIG. 3.

Further as seen in FIG. 7, the distal end face 5*f* of the support head 5 supports a plurality of bristles 6 of different lengths. Particularly, the first distal end face F1 supports bristles of short length, and the second distal end face F2 provides support bristles of long length. The bristles of the longest length are located on the second distal end face F2, more particularly, the longest bristles are located close to an outer edge of the second distal end face F2 that adjoins the front face 5*a* of the support head 5. The length of the bristles on the second distal end face F2 decreases gradually towards the ridge 13 and increases on moving away from the ridge 13. A row of bristles 6 is located on the ridge 13. The row of bristles 6 located on the ridge 13 is shorter in length than bristles 6 of the second distal end face F2 but longer in length than the bristles 6 of the first distal end face F1. The length of bristles 6 may range between 3-8 mm. Further, free distal ends of the plurality of bristles 6 form a wavy plane. In alternate embodiments, however, the free distal ends of the plurality of bristles 6 may not form a wavy plane.

The brush 10 thus includes a mix of soft and hard bristles 6*c*. The soft bristles are the bristles 6 that are longer in length and are located on the first distal end face F2 near the outer edge adjoining the front face 5*a*. The hard bristles are bristles 6 that are short in length and are located on the first distal end face F1 near the outer edge adjoining the back face 5*a*. The intermediate bristles 6 are of medium hardness.

In the present embodiment, as seen in FIG. 10, the number of bristles 6 on the distal end face 5*f* are less than 20. In alternate embodiments, the number of bristles may be more than 20.

Moreover, each bristle 6 has a conical shape, with a free top end diameter of the bristle 6 being about 0.14 mm and a base diameter of the bristle 6 being about 0.3 mm. Further, the top end of each of the bristles 6 is rounded for providing smoothness. In alternate embodiments, not shown, the bristles can be of any other shape known in the art.

It is also worth noting that the bristles 6 all maintain a defined spacing from each other, i.e., the individual bristles 6 do not come in contact with neighboring bristles when there is no application force.

Further, a ratio of the length of the support head 5 and the length of the bristles 6 ranges from about 2:3 to 3:2.

According to an embodiment of the present disclosure, at least a part of the brush 10 includes the shank member 7 and the applying member 8 can be made by molding, e.g. by injection-molding, in a material selected from the following list: thermoplastic materials; elastomers; thermoplastic elastomers; thermoplastic elastomer polyester such as LDPE, HYTREL®, for example; nitrile rubber; silicone rubber; ethylene-propylene-diene monomer (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

According to an embodiment of the present disclosure, the brush 10 can be made, at least in part, from a material that is more flexible than the material from which the stem 20 is made.

In the first embodiment, the wiper 206 serves to wipe off not only the excess cosmetic product attached to the applying member 8 but also the cosmetic product attached to the stem 20.

According to the first embodiment, the receptacle 200 and the cap 30 may be made of a rigid material like glass, metal, hard plastic, or any other material known in the art.

However, in alternate embodiments, the receptacle 200 and the cap 30 may be made of a flexible material like flexible polymeric material or any other material known in the art.

According to the first embodiment of the present disclosure, the stem 20 presents a circular cross-section, but it is not beyond the ambit of the present disclosure for this to be otherwise, in particular when the cross-section of the stem 20 is oval, elliptical, or polygonal, e.g. square, triangular or rectangular. The stem 20 can be solid as shown, or, in a variant, it could be hollow.

When the stem 20 is not of circular cross-section, the cap 30 can be fastened on the receptacle 200 by snap-fastening or by some other means, without turning relative to said receptacle 200. The wiper 206 can thus present a non-circular wiper orifice 215 of the section that is complementary to the section of the stem 20.

According to the present disclosure, the stem 20 can have a longitudinal axis that is rectilinear as shown. However, in alternate embodiments, it could be curved.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the disclosure. In addition, those skilled in the art may readily change or modifications to the disclosed embodiments, based on the present specification, such changes or modifications also belong to the scope of the present disclosure will be apparent.

What is claimed is:

1. A brush for applying a cosmetic or a care product, the brush comprises:

an applying member elongated along a longitudinal axis;

wherein a proximal portion of the applying member includes a support head and a distal portion of the applying member includes a plurality of bristles;

wherein the plurality of bristles extends from a distal end face of the support head along the longitudinal axis of the applying member;

wherein the support head further includes a front face, a back face, a right face, a left face, and the distal end face;

wherein the front face is opposing the back face, and the left face is opposing the right face;

wherein the front face of the support head has a length less than a length of the back face of the support head;

wherein the distal end face of the support head comprises a first distal end face and a second distal end face;

wherein the first distal end face and the second distal end face are substantially flat surfaces and are disposed in different planes from one another;

wherein the first distal end face and the second distal end face intersect each other to form a ridge on the distal end face at their intersection;

wherein the ridge on the distal end face extends along an axis perpendicular to a longitudinal axis of the support head;

wherein the plurality of bristles on the distal end face includes bristles of different lengths including bristles of short length and bristles of long length; wherein the first distal end face supports the bristles of short length, and the second distal end face supports the bristles of long length; and wherein the length of the bristles on the second distal end face decreases gradually towards the ridge and increases on moving away from the ridge;

wherein the first distal end face and the second distal end face intersect at an angle of between 100-120 degrees;

wherein an inclination angle of the first distal end face with respect to the longitudinal axis of the applying member is in a range between 100 to 110 degrees; and wherein an inclination angle of the second distal end face with respect to the longitudinal axis of the applying member in a range from 130 to 150 degrees.

2. The brush according to claim 1, wherein each of the front face and the back face of the support head includes multiple longitudinal grooves, and each of the left face and the right face of the support head is devoid of the longitudinal grooves; and wherein the longitudinal grooves extend on the complete length of each of the front face and the back face.

3. The brush according to claim 2, wherein each of the front face and the back face of the support head has four longitudinal grooves; and wherein a longitudinal spacing region is provided between two adjacent longitudinal grooves.

4. The brush according to claim 2, wherein at least one longitudinal groove of the longitudinal grooves has a predefined constant width along an entire length of the at least one longitudinal groove; and wherein the longitudinal grooves have the same widths.

5. The brush according to claim 1, wherein a proximal portion of the support head has a constant transverse cross-section; wherein a distal portion of the support head has varying transverse cross-sections along a longitudinal axis of the support head; and wherein the area of the transverse cross-sections of the distal portion of the support head decreases towards the distal end of the support head.

6. The brush according to claim 5, wherein the shape of the constant transverse cross-section of the support head comprises four sides, with a pair of opposing sides being flat, and the other pair of opposing sides having an outwardly curved profile, and with all four corners rounded.

7. The brush according to claim 1, wherein a surface area of the front face of the support head is at least 30% lesser than a surface area of the back face of the support head; and wherein the length of the front face is at least one-third of the length of the back face of the support head and at most three-fourths the length of the back face of the support head.

8. The brush according to claim 1, wherein a surface area of the first distal end face is at least 10% and at most 40% of a total surface area of the distal end face; and wherein a surface area of the second distal end face is at least 60% and at most 90% of the total surface area of the distal end face.

9. The brush according to claim 1, wherein the second distal end face extends along at least 30% of a length of the support head and at most 50% of the length of the support head; and wherein the first distal end face extends along at most 5% of the length of the support head.

10. The brush according to claim 1, wherein the left face and the right face of the support head are symmetrical relative to a plane of symmetry comprising a central longitudinal axis of the brush.

11. The brush according to claim 1, wherein a row of bristles is located on the ridge; wherein the row of bristles located on the ridge is shorter in length than the bristles located on the second distal end face but longer in length than the bristles on the first distal end face of the support head.

12. The brush according to claim 1, wherein a length of the plurality of bristles ranges between 3-8 mm.

13. The brush according to claim 1, wherein a ratio of a length of the support head to a length of the plurality of bristles range from about 2:3 to 3:2.

14. The brush according to claim 1, wherein the brush is incorporated in a cosmetic package; wherein the cosmetic package comprises a receptacle for holding a product and a cosmetic applicator; wherein the cosmetic applicator comprises the brush, a stem, and a cap; and wherein the brush is retained at a distal end of the stem for applying the product and the cap at a proximal end of the stem.

15. The brush according to claim 14, wherein the cosmetic package includes a wiper in the neck of the receptacle for wiping off excess product from the cosmetic applicator; wherein a distal portion of the brush defines the applying member, and a proximal portion of the brush defines a shank member; and wherein the shank member is configured to be received and retained within the cavity of the stem.

16. A brush for applying a cosmetic or a care product, the brush comprises:

an applying member elongated along a longitudinal axis;

wherein the applying member includes a support head elongated along the longitudinal axis of the applying member;

wherein a plurality of bristles extends from a distal end face of the support head along a longitudinal axis of the support head;

wherein the support head further includes a front face, a back face, a right face, a left face, and the distal end face;

wherein the front face, the back face, the right face, and the left face of the support head are bristle-free;

wherein the front face is opposing the back face, and the left face is opposing the right face;

wherein the distal end face of the support head comprises a first distal end face and a second distal end face:

wherein the first distal end face and the second distal end face intersect each other to form a ridge on the distal end face at their intersection;

wherein the ridge on the distal end face extends along an axis perpendicular to a longitudinal axis of the support head;

wherein each of the front face and the back face of the support head includes multiple longitudinal grooves, and each of the left face and the right face of the support head is devoid of the longitudinal grooves; wherein the longitudinal grooves extend on the complete length of each of the front face and the back face;

wherein an inclination angle of the first distal end face with respect to the longitudinal axis of the applying member is in a range between 100 to 110 degrees; and wherein an inclination angle of the second distal end face with respect to the longitudinal axis of the applying member in a range from 130 to 150 degrees.

17. A brush for applying a cosmetic or a care product, the brush comprises:

an applying member elongated along a longitudinal axis, wherein the applying member includes a support head elongated along the longitudinal axis of the applying member;

wherein a plurality of bristles extends from a distal end face of the support head along a longitudinal axis of the applying member;

wherein the distal end face of the support head comprises a first distal end face and a second distal end face;

wherein the first distal end face and the second distal end face intersect each other to form a ridge on the distal end face;

wherein the first distal end face is planar and inclined with respect to the longitudinal axis of the support head;

wherein a row of bristles is located on the ridge;

wherein the row of bristles located on the ridge is shorter in length than the bristles located on the second distal end face but longer in length than the bristles on the first distal end face of the support head;

wherein the second distal end face is planar and inclined with respect to the longitudinal axis of the support head; and wherein the first distal end face and the second distal end face intersect at an angle of between 100 to 120 degrees.

18. The brush according to claim 17, wherein a proximal portion of the support head has a constant transverse cross-section; wherein the shape of the constant transverse cross-section of the support head comprises four sides, with a pair of opposing sides being flat, and the other pair of opposing sides having an outwardly curved, and with all four corners rounded.

* * * * *